United States Patent [19]

Barlow et al.

[11] 4,126,961

[45] Nov. 28, 1978

[54] ARTICULATED DOLL

[75] Inventors: Gordon A. Barlow, Evanston; Harry Disko, South Barrington, both of Ill.

[73] Assignee: Marvin Glass & Associates, Chicago, Ill.

[21] Appl. No.: 658,831

[22] Filed: Feb. 17, 1976

[51] Int. Cl.[2] ..... A63H 13/00

[52] U.S. Cl. ..... 46/119

[58] Field of Search ..... 46/164, 118, 119, 120, 46/135 R, 138, 139, 168, 123

[56] References Cited

U.S. PATENT DOCUMENTS

| | | | |
|---|---|---|---|
| 1,328,100 | 1/1920 | Poore | 46/168 |
| 1,488,890 | 4/1924 | Muller | 46/123 |
| 2,137,371 | 11/1938 | Marsh | 46/120 |
| 2,334,290 | 11/1943 | Richter | 46/119 |
| 2,540,484 | 2/1951 | Kellner | 46/119 |
| 2,648,161 | 8/1953 | Stewart | 46/120 |
| 2,764,841 | 10/1956 | Birnbaum | 46/119 |
| 3,273,280 | 9/1966 | Karton | 46/164 X |
| 3,803,756 | 4/1974 | Strongin | 46/209 X |

FOREIGN PATENT DOCUMENTS

| | | | |
|---|---|---|---|
| 52,573 | 6/1890 | Fed. Rep. of Germany | 46/199 |
| 405,512 | 11/1924 | Fed. Rep. of Germany | 46/123 |
| 477,150 | 6/1929 | Fed. Rep. of Germany | 46/123 |

*Primary Examiner*—F. Barry Shay
*Attorney, Agent, or Firm*—Mason, Kolehmainen, Rathburn & Wyss

[57] ABSTRACT

An articulated doll which includes a torso portion and a head portion mounted on the top of the torso portion by a universal connection permitting nodding, twisting and universal movement of the head portion relative to the torso portion. A singular manually manipulatable mechanism is mounted on the torso portion for universal movement relative thereto and includes a handle portion exposed on the exterior of the torso portion for operation thereof. A linkage structure is provided between the manually manipulatable mechanism and the universal connection between the head portion and torso portion for transmitting motion thereto to effect the universal movement of the head portion relative to the torso portion.

3 Claims, 7 Drawing Figures

Fig 1
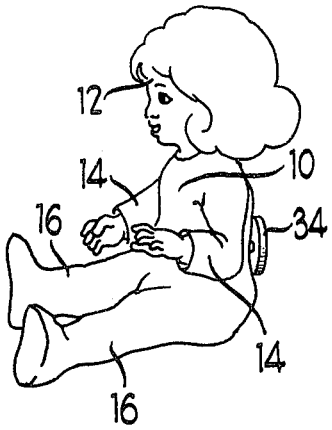
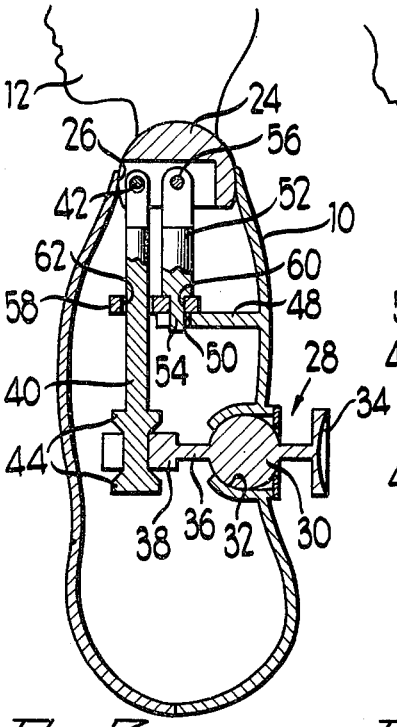
Fig 3
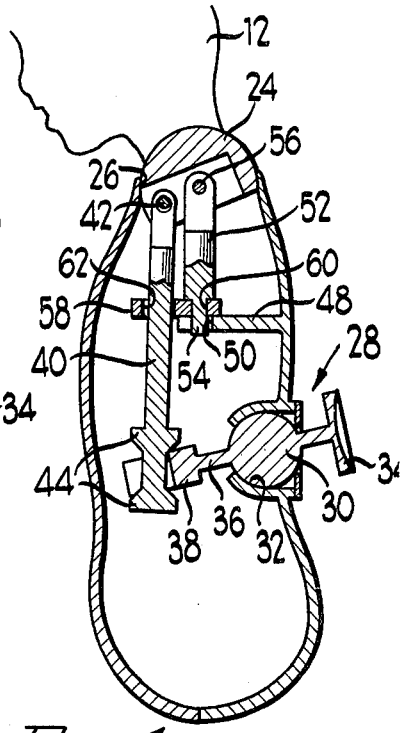
Fig 4
Fig 2
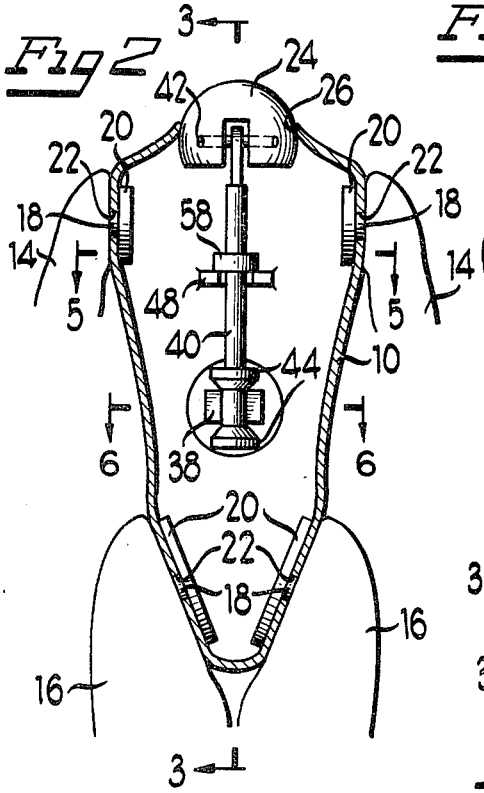
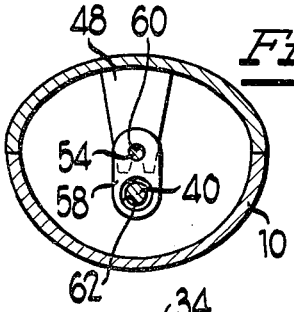
Fig 5
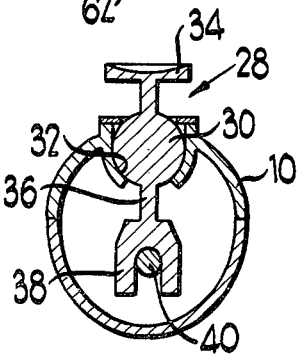
Fig 6
Fig 7
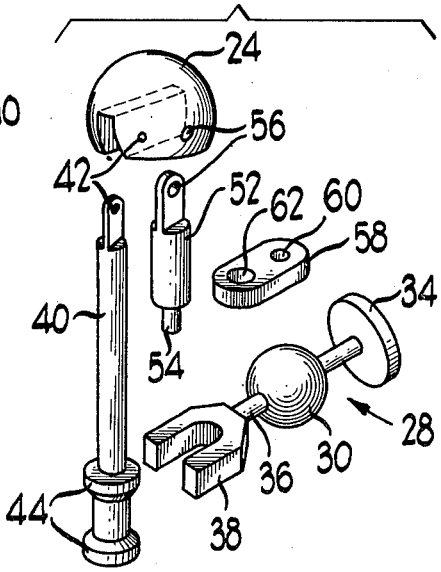

ARTICULATED DOLL

BACKGROUND AND SUMMARY OF THE INVENTION

This invention relates to an articulated doll and particularly to an articulated doll providing movement between a head portion thereof and a torso portion thereof.

Heretofore, articulated dolls have been provided in which a manually manipulatable device, normally disposed within the torso of the doll, effects movement of a head portion of the doll relative to the torso portion. For instance, U.S. Letters Pat. Nos. 2,701,933; 2,764,841; and 3,376,665 provide means on the torso portion whereby the torso portion can be depressed so as to effect movement of the head of the doll relative to the torso portion. However, the head is moved only in a uni-directional motion. U.S. Letters Pat. Nos. 2,137,371 and 2,334,290 also show remote mechanisms for moving a head of a doll relative to the torso thereof in a uni-directional motion either by movement of the doll's arms or by a separate lever, in the latter patent, by means within the torso of the doll. Other patents, such as U.S. Letters Pat. No. 3,757,463, assigned to the assignee of the present invention, shows means remote from the head of the doll for effecting plural motions of the doll, but only in discreet vertical and horizontal directions. The present invention is directed to providing a doll with head motion which not only can nod in a vertical path about a horizontal axis and a twisting path about a vertical axis but also providing universal movement to give realism and life-like movement of the head of a doll relative to the torso portion thereof.

It is an object, therefore, to provide a doll of the character described.

In the exemplary embodiment, the doll is provided with a head portion mounted on top of a torso portion by means of a ball and socket type joint. A singular manually manipulatable mechanism is provided on the torso of the doll remote from the head portion thereof by means of a ball and socket joint having a handle portion exposed on the exterior of the torso portion for grasping by a user, particularly a child. The handle is connected to the ball and a horizontal linkage member is fixed to the ball for movement therewith. A vertical linkage member is pivotally connected to the ball for the head portion and is universally connected for movement with the horizontal member connected to the manually manipulatable ball. The vertical linkage member extends through a horizontal guide member to insure substantially vertical movement thereof and the guide member is pivotally connected to the base of a stabilizing vertical support member which, at its upper end, is pivoted to the ball of the head portion on an axis parallel to the horizontal axis at the upper end of the vertical linkage member. The lower end of the stabilizing vertical support member is pivoted on a vertical axis to a fixed frame member within the torso of the doll.

Other objects, features and advantages of the invention will be apparent from the following detailed description taken in connection with the accompanying drawings.

BRIEF DESCRIPTION OF THE DRAWINGS

FIG. 1 is a perspective view of an articulated doll in accordance with the present invention;

FIG. 2 is a vertical section through the torso of the doll of FIG. 1, on an enlarged scale, with portions of the arms and legs of the doll and the head of the doll removed to facilitate the illustration;

FIG. 3 is a vertical section taken generally along the line 3—3 of FIG. 2 with the doll's head in an erect position;

FIG. 4 is a vertical sectional view similar to that of FIG. 3 with the doll's head pivoted forward by movement of the manually manipulatable means;

FIG. 5 is a horizontal section taken generally along the line 5—5 of FIG. 2;

FIG. 6 is a horizontal section taken generally along the line 6—6 of FIG. 2; and FIG. 7 is a perspective, exploded view of the various operative components between the torso portion and the head portion of the doll.

DESCRIPTION OF THE PREFERRED EMBODIMENT

Referring first to FIGS. 1 and 2, an articulated doll is provided with a torso portion 10, a head portion 12 (not shown in FIG. 2), arms 14, and legs 16. The arms and legs are connected to the torso portion by stub shafts 18 having resilient flanges 20 inserted through apertures 22 in the torso portion 10 so as to provide pivoting movement as is understandable from FIG. 2.

The head portion 12 is connected to the torso portion 10 by means of a ball and socket joint including a ball 24 encapsulated within a socket 26 at the top of the torso portion 10. The head portion 12 is affixed to the ball by any appropriate means such as molding or adhesives.

Referring to FIGS. 3, 4, 6 and 7, a singular manually manipulatable means, generally designated 28, is provided on the backside of the torso portion 10 of the doll for manual manipulation by a user, particularly a child. More particularly, the manually manipulatable means comprises a ball and socket type joint including a ball 30 encapsulated within a socket 32 and includes a handle 34 exposed exteriorly of the torso portion 10 for manual manipulation of the ball 30. A generally horizontally extending arm 36 is formed integral with the ball 30 opposite the handle 34 on the interior of the torso portion 10 and terminates in a yoke 38.

The arm 36 and yoke 38 form part of a linkage between the manually manipulatable ball 30 and the head ball 24. The yoke receives the lower end of a vertical linkage arm 40 which is pivoted to the head ball 24 by a horizontal axle 42 at the upper end of the vertical linkage arm and is received within the yoke 38 at its lower end and maintained therein by enlargement 44.

As seen in FIGS. 3 and 4, a frame member 48 is formed integral with the interior backside of the torso portion 10 and extends inwardly thereof and includes a vertical aperture 50. A vertical stabilizing support member 52 has a lower pin portion 54 extending through the aperture 50 to form a vertical axis thereby. The stabilizing support member 52 is pivoted to the head ball 24 about a pivot axle 56 generally parallel to the pivot axle 42 at the top of the vertical linkage arm 40. The purpose of the stabilizing vertical support member 52 is to insure that there is full swiveling or rotational motion of the head portion 12 relative to the torso portion as the handle 34, through ball 30, moves the vertical linkage arm 40 in an orbital path about the axis provided by the pin 54 at the base of the stabilizing support member 52.

In addition, guide means in the form of a horizontal member 58 is provided and has an aperture 60 through which the pin 54 extends and a second horizontally spaced aperture 62 through which the vertical linkage arm 40 extends so as to guide the linkage arm in a uniform orbital path.

In view of the foregoing, it is apparent that by utilizing a universal movement between the head portion and torso portion of the doll, a universal movement between the manually manipulatable handle 34 and the torso portion of the doll, and the linkage, stabilizing and guide members permits total universal movement of the head portion of the doll relative to the torso portion and is not limited in any way to a unitary nodding, a unitary swiveling, or combination thereof, and provides a new and improved articulated doll.

The foregoing detailed description has been given for clearness of understanding only and no unnecessary limitations should be understood therefrom as some modifications will be obvious to those skilled in the art.

We claim:

1. An articulated doll, comprising:

a torso portion;

a head portion;

means mounting said head portion onto said torso portion for universal movement relative thereto;

a singular manually manipulatable means at least partially exposed on the exterior of said torso portion; and linkage means between said manually manipulatable means and said mounting means for transmitting motion thereto, said manually manipulatable means comprising a ball and socket structure on said torso portion, the ball being connected to said linkage means and having a handle fixed thereto exposed on the exterior of said torso portion for manual manipulation of the ball to transmit motion to said linkage means, wherein said linkage means includes a horizontal arm fixed to said ball for movement therewith, a vertical arm connected to said head portion, and a universal connection between said vertical arm and said horizontal arm and including guide means intermediate the ends of said vertical arm limiting the vertical arm to substantially vertical movement and means to guide the vertical arm also in a generally circular path in response to rotation of said ball, said guide means comprising a generally horizontal guide member having an aperture therethrough through which said vertical arm extends for vertical guidance thereof, said horizontal guide member being pivoted about a vertical axis spaced from said aperture to effect nodding, twisting and universal movement to said head portion.

2. The articulated doll of claim 1 including a vertical stabilizing support member, the bottom of which extends through a vertical aperture in a fixed frame member within said torso and forms the pivot axis for said stabilizing support member and also is connected to said head mounting means by a pivot axis generally parallel to the pivot axis at the upper end of said vertical arm of said linkage means.

3. The articulated doll of claim 2 wherein said mounting means for said head portion onto said torso portion comprises a ball and socket joint, the ball portion thereof being connected to said head portion and the top of said vertical arm and said vertical stabilizing support member being pivotally connected to said ball.

* * * * *